US007372446B2

(12) United States Patent
Murase et al.

(10) Patent No.: US 7,372,446 B2
(45) Date of Patent: May 13, 2008

(54) DISPLAY DEVICE, METHOD FOR DRIVING THE SAME, AND PORTABLE TERMINAL APPARATUS USING THE SAME

(75) Inventors: Masaki Murase, Kanagawa (JP); Yoshiharu Nakajima, Kanagawa (JP)

(73) Assignee: Sony Corporation, Tokyo (JP)

( * ) Notice: Subject to any disclaimer, the term of this patent is extended or adjusted under 35 U.S.C. 154(b) by 28 days.

(21) Appl. No.: 11/207,211

(22) Filed: Aug. 19, 2005

(65) Prior Publication Data

US 2006/0017683 A1 Jan. 26, 2006

Related U.S. Application Data

(63) Continuation of application No. 10/427,804, filed on Apr. 30, 2003, now Pat. No. 6,958,745.

(30) Foreign Application Priority Data

May 2, 2002 (JP) ..... 2002-130252

(51) Int. Cl.
*G09G 3/36* (2006.01)

(52) U.S. Cl. ..... 345/100; 345/99; 345/204

(58) Field of Classification Search ..... 345/87–90, 345/92–95, 99–100, 103, 204, 211–214; 365/231

See application file for complete search history.

(56) References Cited

U.S. PATENT DOCUMENTS

| | | | | |
|---|---|---|---|---|
| 5,363,118 | A | 11/1994 | Okumura | |
| 6,078,542 | A | 6/2000 | Tomishima | |
| 6,191,779 | B1 * | 2/2001 | Taguchi et al. | 345/204 |
| 6,522,317 | B1 * | 2/2003 | Satou et al. | 345/98 |
| 6,593,920 | B2 * | 7/2003 | Okumura et al. | 345/204 |
| 6,600,484 | B1 * | 7/2003 | Miyagawa | 345/212 |
| 6,646,637 | B1 * | 11/2003 | Kageyama et al. | 345/204 |
| 2001/0033278 | A1 | 10/2001 | Ohta et al. | |
| 2003/0034948 | A1 | 2/2003 | Imamura | |
| 2006/0077198 | A1 * | 4/2006 | Okumura et al. | 345/204 |

* cited by examiner

*Primary Examiner*—Richard Hjerpe
*Assistant Examiner*—Mansour M. Said
(74) *Attorney, Agent, or Firm*—Robert J. Depke; Rockey, Depke & Lyons, LLC.

(57) ABSTRACT

A selection-addressing-type liquid crystal display selectively addresses a signal line of a pixel unit using groups of three selectors of a selector circuit in a time-division manner. A level converter level shifts selector pulses having a voltage swing corresponding to the external-circuit power supply to selector pulses having a voltage swing corresponding to the internal-circuit power supply. In a non-display region in partial display mode, the level converter is deactivated under the control of a control signal to reduce direct current consumption therein.

12 Claims, 7 Drawing Sheets

DISPLAY DEVICE, METHOD FOR DRIVING THE SAME, AND PORTABLE TERMINAL APPARATUS USING THE SAME

The subject matter of application Ser. No. 10/427,804 is incorporated herein by reference. The present application is a continuation of U.S. application Ser. No. 10/427,804, filed Apr. 30, 2003, now U.S. Pat. No. 6,958,745 which claims priority to Japanese Patent Application NoJP2002-130252, filed May 2, 2002. The present application claims priority to these previously filed applications.

BACKGROUND OF THE INVENTION

1. Field of the Invention

The present invention relates to display devices, methods for driving the same, and portable terminal apparatuses using the same. More particularly, the present invention relates to a display device employing a selector circuit addressing method for driving the signal lines of a display panel, a method for driving the same, and a portable terminal apparatus provided with the same as a display unit.

2. Description of the Related Art

Display devices having pixels disposed in a matrix include a liquid crystal display using a liquid crystal cell as the pixel. The liquid crystal display employs the passive matrix system or the active matrix system as the driving method. Recently, for its improved response characteristics and visibility characteristics, most liquid crystal displays have employed the active matrix system. When a liquid crystal panel is driven, the active matrix display selects a scan line to be written with a signal and then feeds the signal from, for example, an external driver IC to a signal line. Thus, the signal is written to the pixel in a matrix determined to be driven.

The external driver IC, which is located outside the panel, drives the signal lines of the liquid crystal panel. When there is a one-to-one correspondence between the output of the external driver IC and each of the signal lines, a driver IC with a number of outputs equal to the number of the signal lines must be prepared. In addition, a corresponding number of wires are required for establishing the connection between the driver IC and the liquid crystal panel. In view of this, there is employed a selector circuit addressing method which assigns a plurality of signal lines to an output of the driver IC as a unit (pair), and selects each of the plurality of signal lines in a time-sharing manner so that an output signal from the driver IC is fed into the selected signal line in a time-sharing manner.

In this selector addressing method, one to x correspondences between the outputs of the driver IC and the signal lines of the liquid crystal panel are specifically set, where x is an integer of at least 2, and all of the x signal lines assigned to one output of the driver IC are selected to be driven every x time divisions. Employing this selector addressing method can reduce the number of wiring connections to 1/x.

A liquid crystal display having a built-in drive circuit is constructed by monolithically forming a pixel unit and a drive circuit for driving the pixel unit on a common substrate (liquid crystal panel). When the selector addressing method is employed by this liquid crystal display having a built-in drive circuit, a selection circuit that serves to distribute one output signal from the output of the driver IC to x signal lines in a time-sharing manner is mounted on the liquid crystal panel. The selector switches in response to selector pulses supplied from an external circuit.

Furthermore, a level converter is mounted on the liquid crystal panel. For example, the level converter level shifts a TTL level signal having a low-voltage swing and supplied from the external IC into a signal having a high-voltage swing required for driving the liquid crystal. The above selector pulse, which uses TTL levels having a low-voltage swing (for example, 0 to 3.3 V), is fed into the level converter where the selector pulse is level shifted to a signal having a high-voltage swing (for example, 0 to 7.7 V) required for driving the liquid crystal panel, which is then is supplied to the selection circuit for time-sharing control.

The liquid crystal display changes its molecular arrangement pattern depending on the presence of an electric field, thus performing transmission/blocking control of light for image display. Since the principle of operation of the liquid crystal display allows it to be driven with little power, these displays are widely used as output display units for, particularly, portable telephones and PDAs (Personal Digital Assistants) using a battery as the main power supply. The liquid crystal displays of this type are being developed to operate with low power consumption by decreasing the driving voltage and the driving frequency. This allows the displays to be operated for a long time.

However, wasteful D.C. consumption occurs in the liquid crystal display with the above selector addressing method because the level converter that level-shits the selector pulse for the external-circuit power voltage to the one for the internal-circuit power voltage is constantly maintained in the ON state. This prevents the power consumption of the entire drive circuit from being decreased. When the liquid crystal display is applied, in particular, to portable terminal apparatuses such as portable telephones and PDAs, lower power consumption of the display device, such as a liquid crystal display, is a very important issue for realizing further reduced power consumption in the portable terminal apparatus.

SUMMARY OF THE INVENTION

Accordingly, it is an object of the present invention to provide a display device, a method for driving the same, and a portable terminal apparatus using the same as a display that achieves low power consumption of the entire apparatus by reducing the power consumed by a direct current, particularly in the level converter, when a selector addressing method is employed.

To do this end, according to a first aspect of the present invention, there is provided A display device including a pixel unit having an array of pixels and signal lines disposed in groups of columns of the array; a level converting unit including x stages of level shifters, wherein x is an integer of at least two, each level shifter for when activated, converting x selection signals having a first voltage swing to selection signals having a second voltage swing, which are output, the x selection signals, corresponding to every x signal lines of the pixel unit, being input in a time-series manner, every x signal lines of the pixel unit being grouped and when deactivated, outputting a signal having a voltage swing, which is latched; a selecting unit comprising a group of x select switches for sequentially selecting said every x signal lines in accordance with the x selection signals that were subjected to level conversion at the level converting unit to provide a display signal; and a control unit for, when partial display mode for displaying only part of a display screen is requested and when pixel writing is performed in a non-display region in which no displaying is performed, feeding an activating signal to the level shifter at a first stage when the select switch of the selecting unit corresponding to the level shifter at a second stage is not selected, feeding an activating signal to a level shifter at one of the second to (x-1)th stages when the select switch of the selecting unit corresponding to the level shifter at the previous stage of said one of said second to (x-1)th stages is selected and when the select switch of the selecting unit corresponding to the level shifter at the following stage of said one of said second to (x-1)th stages is not selected, and feeding an activating signal to the level shifter at the xth stage when the select switch of the selecting unit corresponding to the level shifter at the (x-1)th stage is selected.

According to a second aspect of the present invention, there is provided a method for driving a display device including a pixel unit having an array of pixels, and signal lines disposed in groups of columns of the array; a level converting unit comprising x stages of level shifters, wherein x is an integer of at least two, each level shifter for when activated, converting x selection signals having a first voltage swing to selection signals having a second voltage swing, which are output, the x selection signals, corresponding to every x signal lines of the pixel unit, being input in a time-series manner, every x signal lines of the pixel unit being grouped and when deactivated, outputting a signal having a voltage swing, which is latched; and a selecting unit comprising a group of x select switches for sequentially selecting said every x signal lines in accordance with the x selection signals that were subjected to level conversion at the level converter to provide a display signal. In the method for driving the display device, when partial display mode for displaying only part of a display screen is requested and when pixel writing is performed in a non-display region in which no displaying is performed, an activating signal is fed to the level shifter at a first stage when the select switch of the selecting unit corresponding to the level shifter at a second stage is not selected; an activating signal is fed to a level shifter at one of the second to (x-1)th stages when the select switch of the selecting unit corresponding to the level shifter at the previous stage of said one of said second to (x-1)th stages is selected and when the select switch of the selecting unit corresponding to the level shifter at the following stage of said one of said second to (x-1)th stages is not selected; and an activating signal is fed to the level shifter at the xth stage when the select switch of the selecting unit corresponding to the level shifter at the (x-1)th stage is selected.

According to a third aspect of the present invention, a portable terminal apparatus having the display device according to the first aspect of the present invention is provided.

In the display device and the portable terminal apparatus provided with the above display device as an output display unit, in partial display mode in which displaying is performed on part of the display screen, single-gradation displaying is performed in the non-display region by providing a display signal of a single gradation, such as a white signal in a normally white type display or a black signal in a normally black type display, to the signal lines. Therefore, each select switch of the selecting unit does not have to repeat selection/non-selection operation and only have to be constantly selected. During partial display mode, in the non-display region, the level converting unit is deactivated, and each select switch is set to be constantly selected. This can reduce direct current consumption in the level converting unit compared to when the level converting unit is constantly activated. Hence, direct current consumption in the entire apparatus can be reduced as well.

DESCRIPTION OF THE PREFERRED EMBODIMENTS

Figure 1:
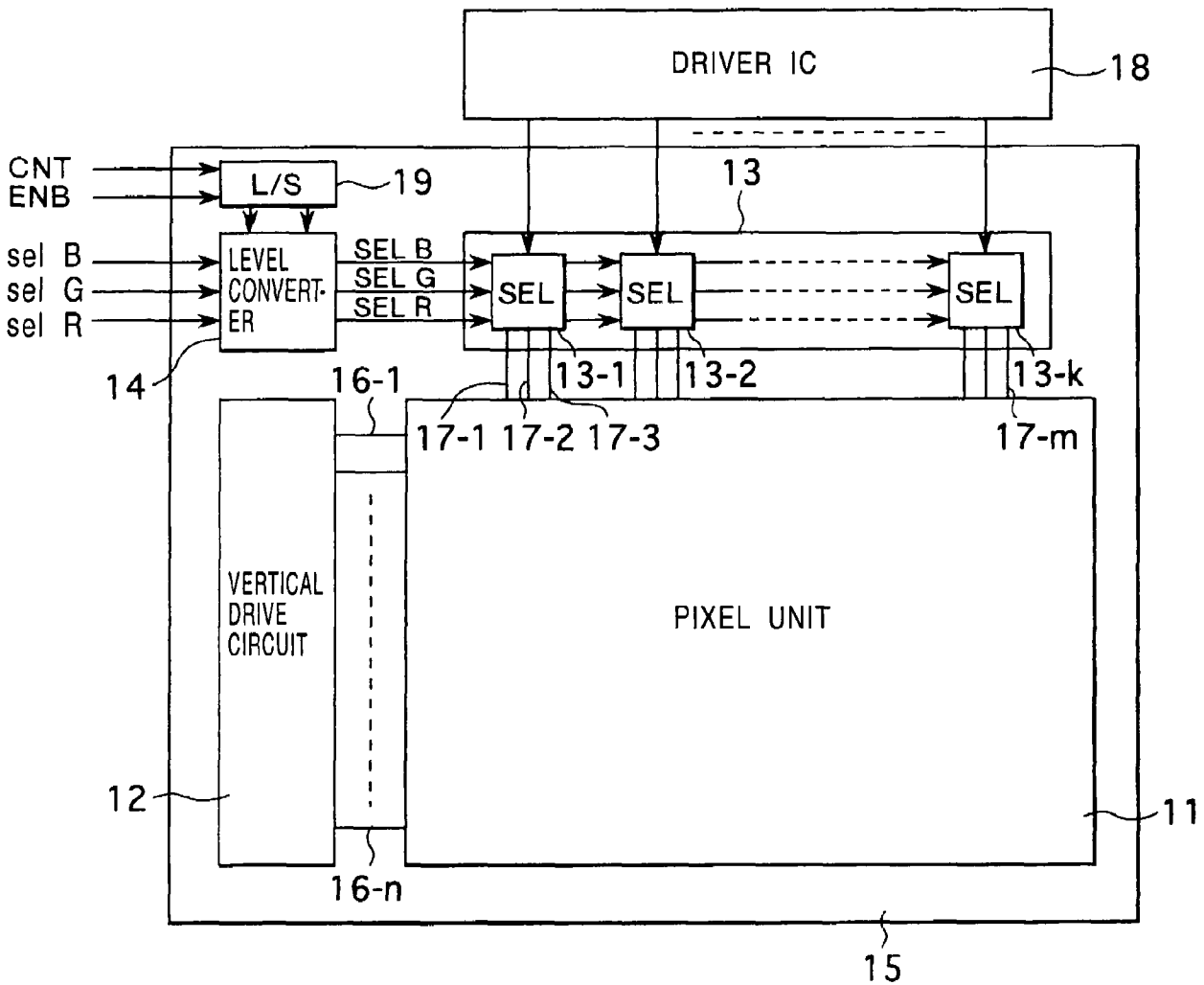
FIG. 1 is a block diagram of a liquid crystal display according to one embodiment of the present invention.

FIG. 1 shows a block diagram of the entire construction of a display device, such as a liquid crystal display using a liquid crystal cell as a display element of a pixel, according to one embodiment of the present invention.

In FIG. 1, the liquid crystal display includes a pixel unit 11, a vertical drive circuit 12, a selection circuit 13, and a level converter 14. The pixel unit 11 includes pixels, each with a liquid crystal cell, disposed in a matrix. The vertical drive circuit 12 selectively drives each pixel of the pixel unit 11 in groups of lines. The selection circuit 13 selectively provides a display signal to pixels of the line driven by the vertical drive circuit 12 by means of the selector addressing method. The level converter 14 level shifts a selector pulse for selectively driving the selection circuit 13.

The liquid crystal display has a built-in drive-circuit construction in which the vertical drive circuit 12, the selection circuit 13, and the level converter 14 are monolithically formed on a transparent insulator (hereinafter, referred to as a liquid crystal panel 15), such as a glass substrate or a plastic substrate, with the pixel unit 11 formed thereon. The liquid crystal panel 15 includes a TFT (Thin Film Transistor) substrate, an opposing substrate, and liquid crystal material sandwiched therebetween to be enclosed. The TFT substrate is a transparent insulating substrate having a switching element, such as a TFT, formed thereon at each pixel. The opposing substrate is a transparent insulating substrate having color filters, an opposing electrode, or the like formed thereon.

Figure 2:
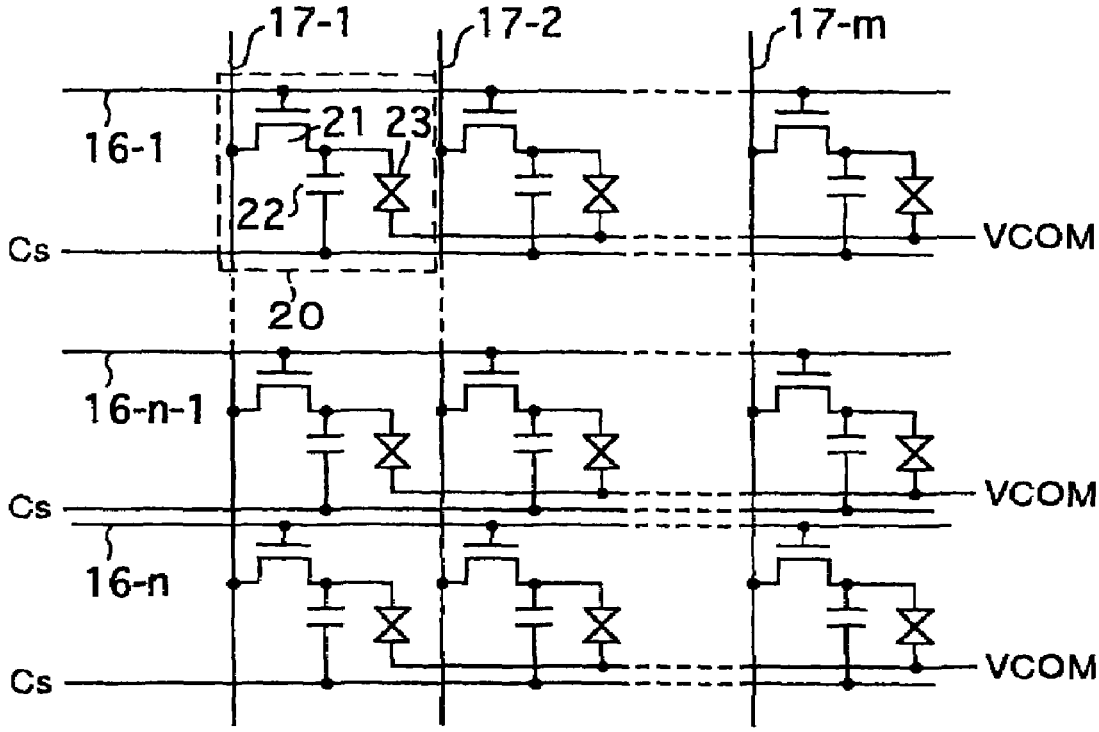
FIG. 2 is a circuit diagram showing a basic construction of a pixel circuit.

In the pixel unit 11, n scan lines 16-1 to 16-n and m signal lines 17-1 to 17-m are wired in an n ×m array of pixels in a matrix. Pixels 20 are disposed at the intersections of the scan lines 16-1 to 16-n and the signal lines 17-l to 17-m. As shown in FIG. 2, each pixel 20 includes a switching element, such as a TFT (pixel transistor) 21, a hold capacitance 22, and a liquid crystal capacitance 23. One end of the hold capacitance 22 is connected to the drain electrode of the TFT 21, and a pixel electrode of the liquid crystal capacitance 23 is connected to the drain electrode of the TFT 21.

The liquid crystal capacitance 23 means the capacitance generated between a pixel electrode formed on the TFT 21 and an opposing electrode formed so as to face the pixel electrode. In each TFT 21, the source electrode thereof is connected to the respective signal line 17-1 to 17-m while the gate electrode thereof is connected to the respective scan line 16-1 to 16-n. A constant electrical potential Cs is applied to the other end of the hold capacitance 22 while a common voltage VCOM is applied to the opposing electrode of the liquid capacitance 23.

The pixel 20 with the above-described basic circuit construction is given only as an example. Each pixel 20 may include a memory so that a combination of normal displaying using an analog image signal and still image displaying using digital image data held in the memory can be accommodated.

The vertical drive circuit 12 includes a shift register, for example. The vertical drive circuit 12 sequentially feeds scanning pulses to the scan lines 16-1 to 16-n of the pixel unit 11 for sequentially selecting each pixel circuit in groups of lines to perform vertical scanning. Although disposed only on one side of the pixel unit 11 in the present embodiment, the vertical drive circuit 12 may be disposed on both sides of the pixel unit 11. This latter construction where they are disposed at both sides can prevent transmission delays of the scanning pulses.

The liquid crystal display employs the selector addressing method (time division addressing method) in order to drive the signal lines 17-1 to 17-m of the liquid crystal panel 15. In the pixel unit 11, for example, every x adjacent signal lines are grouped together from among the signal lines 17-1 to 17-m (x is an integer of at least 2). When the liquid crystal panel 15 is a color display with pixels 20 having a repetitive pattern of, for example, blue (B), green (G), and red (R) disposed in the horizontal direction, every three adjacent signal lines (BGR) are grouped together from among the signal lines 17-1 to 17-m. That is, each signal line of each group undergoes three-time-division addressing.

In the liquid crystal panel 15, an amount of digital image signal data corresponding to m/3 channels is fed to the m signal lines 17-1 to 17-m from an external driver IC 18. That is, the external driver IC 18 provides BGR color signals to the respective three signal lines of a group corresponding to each channel in a time series manner, and the time-series color signals are fed to the selection circuit 13. The selection circuit 13 samples the time-series signals from each channel of the driver IC 18 in a time-division manner and sequentially feeds the sampled signals to the respective three signal lines of each group.

Figure 3:
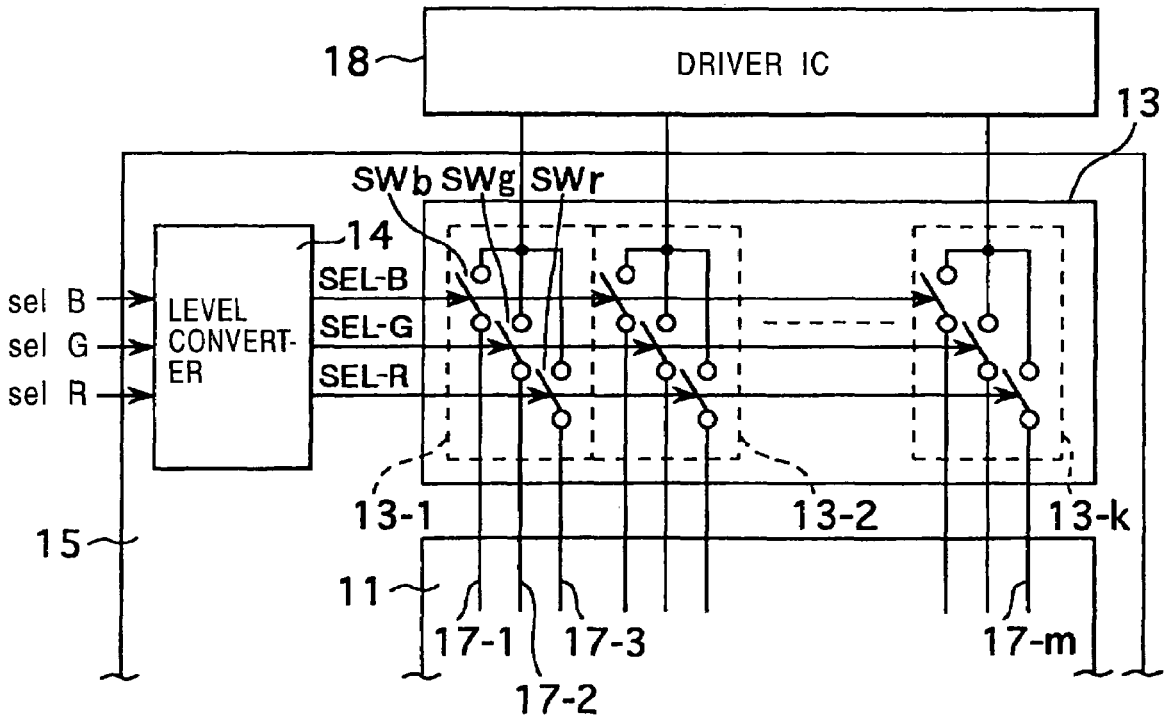
FIG. 3 is a conceptual diagram of a three-time-division addressing selector circuit.

FIG. 3 shows a conceptual diagram of the three-time-division addressing selection circuit 13. The selection circuit 13 includes selectors 13-1 to 13-k (k=m/3), which are each connected between one corresponding output of the driver IC 18 and the three signal lines of the corresponding group. The selectors 13-1 to 13-k correspond to the outputs of the driver IC 18 and each includes three analog switches SWb, SWg, and SWr that sample signals provided to these respective signal lines in a time-division manner.

When three pixel signals (B, G, R) are produced from one output line of the driver IC 18 in a time-series manner, the analog switches SWb, SWg, and SWr sequentially distribute these signals to the three signal lines by means of the time-division addressing method. The analog switches SWb, SWg, and SWr are sequentially turned ON/OFF in accordance with selector pulses SEL-B, SEL-G, and SEL-R, respectively.

The selector pulses SEL-B, SEL-G, and SEL-R are produced as follows: selector pulses sel-B, sel-G, and sel-R are supplied from a timing generator (not shown) disposed outside or inside of the liquid crystal panel 15; and the level converter 14 level shifts the selector pulses sel-B, sel-G, and sel-R, which have a voltage swing corresponding to the external-circuit power supply (e.g., 0 to 3.3 V) to the selector pulses SEL-B, SEL-G, and SEL-R, which have a voltage swing corresponding to the internal-circuit power supply (e.g., 0 to 7.3 V) required for driving the liquid crystal.

The timing generator further provides a control signal CNT and an enable signal to the liquid crystal panel 15. For example, in partial display mode (hereinafter, referred to as partial mode) for displaying only part of the display screen, the control signal CNT is at a HIGH level (hereinafter, referred to as "H" level) while displaying is performed in a normal display region, and the control signal is at a LOW level (hereinafter, referred to as "L" level) while no displaying is performed in a non-display region. The enable signal ENB represents information regarding one horizontal period (1H) where the signal level is the "H" level during the write period of one horizontal period and the "L" level during the blanking period.

The control signal CNT and the enable signal ENB each have a voltage swing corresponding to the external-circuit power supply, like the selector pulses sel-B, sel-G, and sel-R. After being fed to the liquid crystal panel 15, these signals CNT and ENB each having a voltage swing corresponding to the external-circuit power supply, are level shifted by a level converter 19 to the signals each having a voltage swing corresponding to the internal-circuit power supply. The level shifted signals CNT and ENB are further fed to the level converter 14. The level converter 14, which level shifts the selector pulses sel-B, sel-G, and sel-R, and the level converter 19, level shifts the control signal CNT and the enable signal ENB, greatly differ with respect to the number of operations during one horizontal period.

Now, the construction and operation of the level converter 14 will be described.

Figure 4:
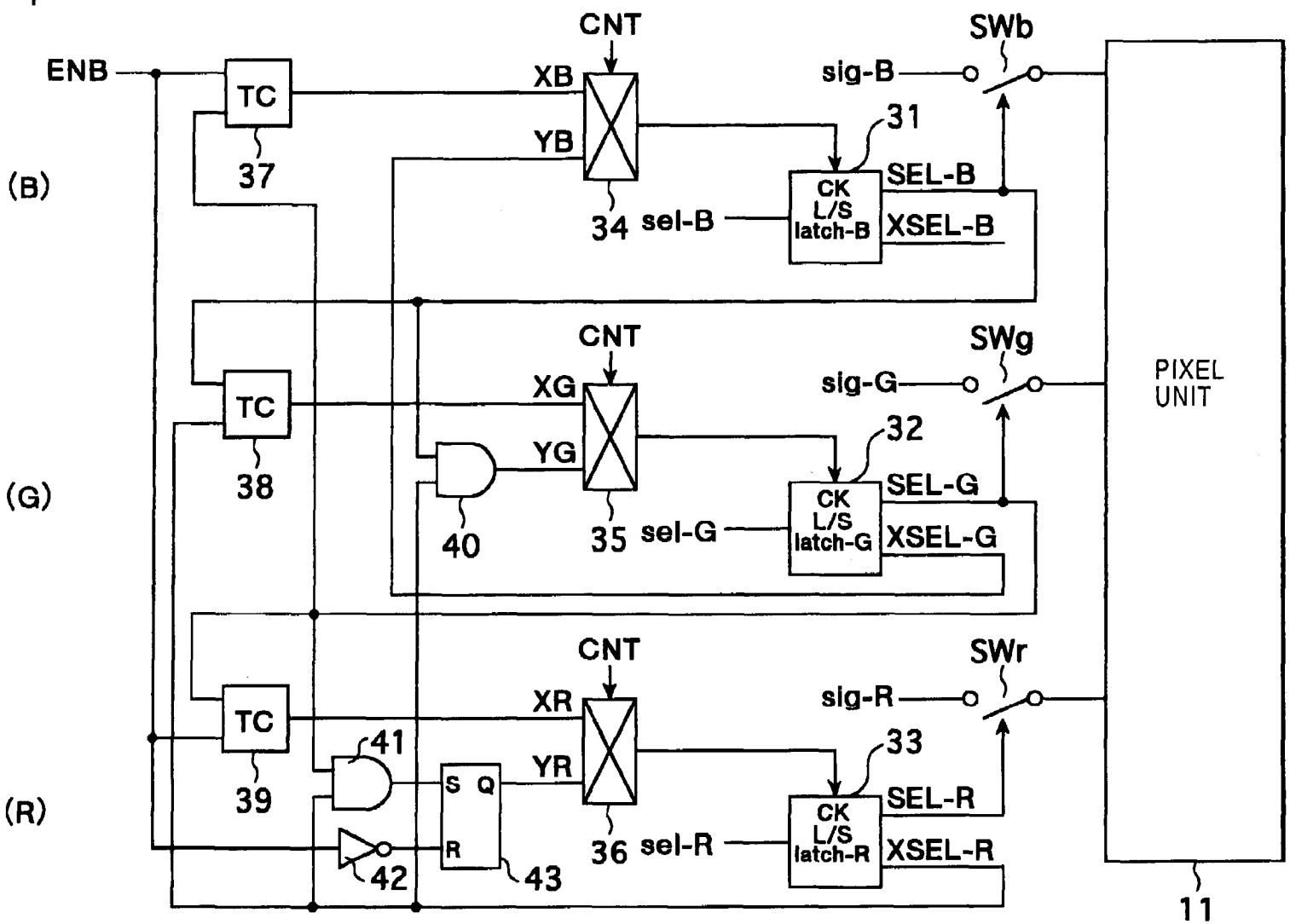
FIG. 4 is a block diagram showing one example of an actual construction of a level converter.

FIG. 4 is a block diagram of an example of an actual construction of the level converter 14. For simplicity, only one group of the selector switches SWb, SWg, and SWr among the selectors 13-1 to 13-k is shown. The level converter 14 includes three level shifters (L/S) 31 to 33, three control signal selection circuits 34 to 36, three timing controllers 37 to 39, each three corresponding to B, G, and R color signals (hereinafter, referred to as B level shifter 31, G level shifter 32, R level shifter 33, B control signal selection circuit 34, G control signal selection circuit 35, R control signal selection circuit 36, B timing controller 37, G timing controller 38, and R timing controller 39), and a peripheral logic circuit.

The level shifters 31 to 33 operate under, for example, the internal-circuit power voltage. Each of the level shifters 31 to 33 has the basic construction of a known latch circuit in which the pulses with a voltage swing corresponding to the external-circuit power supply are latched and then level shifted to the pulses with a voltage swing corresponding to the internal-circuit power supply. The level shifters 31 to 33 are selectively set in an active/inactive state in accordance with control signals fed from the respective control signal selection circuits 34 to 36 to the CK signal inputs of the respective level shifters 31 to 33.

To be specific, when the CK signal is at the "H" level, the selector pulses sel-B, sel-G, and sel-R, each having the voltage swing corresponding to the external-circuit power supply are level shifted to produce the non-inverted selector pulses SEL-B, SEL-G, and SEL-R and inverted selector pulses XSEL-B, XSEL_G, and XSEL-R, respectively, each having the voltage swing corresponding to the internal-circuit power supply; and when the CK signal is at the "L" level, a pulse with a polarity that is latched is output regardless of the polarities of the input selector pulses sel-B, sel-G, and sel-R.

The non-inverted selector pulse SEL-B is fed from the level shifter 31 to the selector switch SWb as an ON/OFF control signal for controlling the selector switch SWb. The selector pulse SEL-B is also fed to one input of the G timing controller 38 and one input of a two-input AND gate 40.

The non-inverted selector pulse SEL-G is fed from the level shifter 32 to the selector SWg as the ON/OFF control signal for controlling the selector SWg. The selector pulse SEL-G is also fed to one input of the B timing controller 37, one input of the R timing controller 39, and one input of a two-input AND gate 41. The inverted selector pulse XSEL-G is fed to one input of the B control signal selection circuit 34 as a control signal YB.

The non-inverted selector pulse SEL-R is fed to the selector SWr from the level shifter 33 as the ON/OFF control signal for controlling the selector SWr. The inverted selector pulse XSEL-R is fed to the other input of the G timing controller 38 and is also fed to the other inputs of the AND gates 40 and 41.

The level converter 14 receives the control signal CNT and the enable signal ENB via the level converter 19 from the timing generator (not shown) provided outside or inside of the liquid crystal panel 15. In partial mode, the control signal CNT is at the "H" level in the normal display region and at the "L" level in the non-display region. The enable signal ENB represents information regarding one horizontal period where the signal is at the "H" level during the write period and at the "L" level during the blanking period.

The enable signal ENB is fed to the B timing controllers 37 and the R timing controller 39. The enable signal is also inverted by an inverter 42 and then fed to a reset (R) input of an RS flip-flop 43. The output signal from the AND gate 41 is fed to the set (S) input of the RS flip-flop 43, and the output signal from the RS flip-flop 43 is fed to the R control signal selection circuit 36 as a control signal YR. The output signal from the AND gate 40 is fed to the G control signal selection circuit 35 as a control signal YG.

The timing controllers 37, 38, and 39 produce control signals XB, XG, and XR to the B control signal selection circuit 34, the G control signal selection circuit 35, and the R control signal selection circuit 36, respectively. In partial mode, the control signals XB, XG, and XR perform current control of the level shifters 31, 32, and 33 in the normal display region during the write period.

The B control signal selection circuits 34 selects either of the control signals XB and YB to be output in accordance with the logic level of the control signal CNT; the G control signal selection circuits 35 selects either of the control signals XG and YG to be output in accordance with the logic level of the control signal CNT; and the R control signal selection circuits 36 selects either of the control signals XR and YR to be output in accordance with the logic level of the control signal CNT. To be specific, in partial display mode, the control signals XB, XG, and XR are selected when the control signal CNT is at the "H" level, which means when displaying is performed in the normal display region; the control signals YB, YG, and YR are selected when the control signal CNT is at the "L" level, which means when no displaying is performed in the non-display region. The selected signals are fed to the CK inputs of the respective level shifters 31, 32, and 33.

In the active matrix liquid display device having the above construction, the vertical drive circuit 12, the selection circuit 13, and the level converters 14 and 19 are formed along with each pixel transistor of the pixel unit 11 using polysilicon thin-film transistors or CG silicon (Continuous Grain Silicon) transistors on the liquid crystal panel 15 including a transparent insulated substrate. The selection circuit 13 and the level converters 14 and 19 need not be formed in the above-described manner; any one of them may be formed, along with each pixel transistor of the pixel unit 11, using polysilicon thin-film transistors or CG silicon transistors on the liquid crystal panel 15.

Figure 5:
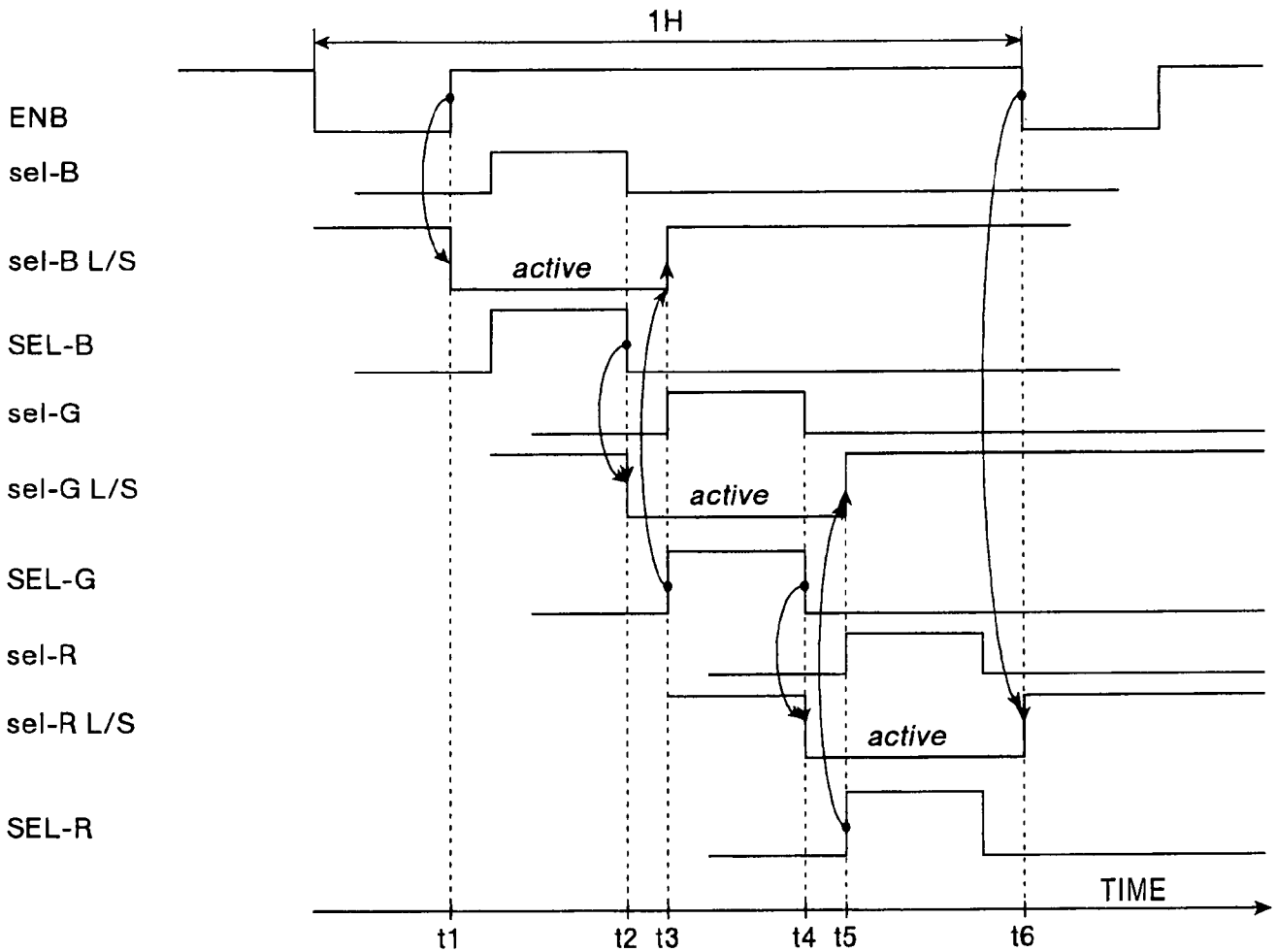
FIG. 5 is a timing chart illustrating an operation of the level converter in normal display mode.

The operation of the level converter 14 will now be described. First, the operation during normal display mode will be described with reference to the timing chart in FIG. 5.

When the enable signal ENB that allows pixels to be written in one horizontal period (1H) is fed to the B timing controller 37, the B timing controller 37 produces the "H" level control signal XB at time t1 when the enable signal ENB goes from the "L" level to the "H" level. Here, the control signal CNT is at the "H" level because the present display mode is normal display mode. Hence, the B control signal selection circuit 34 selects the "H" level control signal XB that is fed to the CK input of the level shifter 31. Providing the "H" level control signal XB to the CK input activates the level shifter 31 that level shifts the selector pulse sel-B, which has the voltage swing corresponding to the external-circuit power supply, to the selector pulse SEL-B, which has the voltage swing corresponding to the internal-circuit power supply.

The level shifted selector pulse SEL_B is fed to the selector switch SWb and the G timing controller 38. The G timing controller 38 produces the "H" level control signal XG at time t2 at the negative edge of the selector pulse SEL-B. In response to the input of the control signal CNT, the G control signal selection circuit 35 selects the "H" level control signal XG that is fed to the CK input of the level shifter 32. Providing the "H" level signal to the CK input activates the level shifter 32 that level shifts the selector pulse sel-G, which has the voltage swing corresponding to the external-circuit power supply, to the selector pulse SEL-G, which has the voltage swing corresponding to the internal-circuit power supply.

The level shifted selector pulse SEL-G is fed to the selector switch SWg and also fed to the B timing controller 37 and the R timing controller 39. The B timing controller 37 produces the "L" level control signal XB at time t3 at the positive edge of the selector pulse SEL-G. The B control signal selection circuit 34 selects this "L" level control signal XB that is fed to deactivate the level shifter 31.

The R timing controller 39 produces the "H" level control signal XR at time t4 at the negative edge of the selector pulse SEL-G. In response to the input of the control signal CNT, the control signal selection circuit 36 selects the "H" level control signal XR that is fed to the CK input of the level shifter 33. Providing the "H" level control signal XR to the CK input activates the level shifter 33 that level shifts the selector pulse sel-R, which has the voltage swing corresponding to the external-circuit power supply, to the selector pulse SEL-R, which has the voltage swing corresponding to the internal-circuit power supply.

The level shifted non-inverted selector pulse SEL-R is fed to the selector switch SWr and the level shifted inverted selector pulse XSEL-R is fed to the G timing controller 38. The G timing controller 38 produces the "L" level control signal XG at time t5 at the positive edge of the selector pulse SEL-R. The G control signal selection circuit 35 selects the "L" level control signal XG that is fed to deactivate the level shifter 32.

The enable signal ENB goes from the "H" level to the "L" level at the end of the write period in one horizontal period, which is time t6 at which the R timing controller 39 produces the "L" level control signal XR. The R control signal selection circuit 36 selects the "L" level control signal XR, which is fed to deactivate the level shifter 33.

The level shifters 31, 32, and 33 are activated while the respective selector pulses sel-B, sel-G, and sel-R are level shifted: otherwise they are deactivated. This indicates that the level converter 14 including the level shifters 31, 32, and 33 is activated only when the respective selector switches SWb, SWg, and SWr are turned on (selected), and otherwise (not selected) the level converter 14 is deactivated.

In the selector circuit 13 performing time-division addressing, the selector switches SWb, SWg, and SWr are not constantly in the ON-state; they repeat ON/OFF operations in turn, which are not necessarily performed in succession. It may suffice that the sequential ON/OFF operations thereof are completed within one horizontal period, with certain interval between the ON/OFF operations of each of the selector switches SWb, SWg, and SWr.

In view of this, in the present invention, when the selector circuit 13 is not selected, the level shifters 31, 32, and 33 of the level converter 14 are constructed to be deactivated. This construction prevents the level converter 14 from consuming direct current in the level shifters 31, 32, and 33 when the selector pulses sel-B, sel-G, and sel-R are not required to be level shifted, which reduces the power consumption in the level converter 14 and, ultimately, in the entire device.

Figure 6:
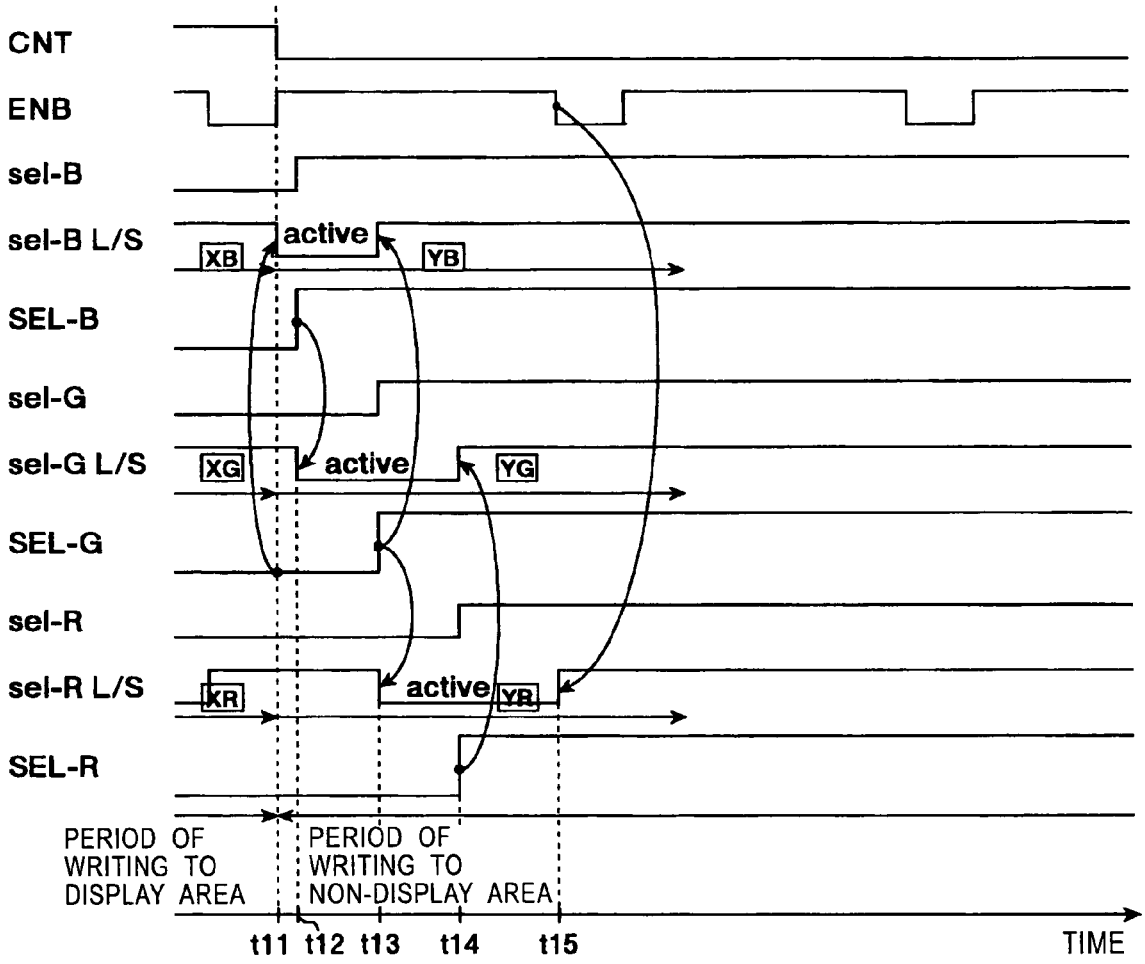
FIG. 6 is a timing chart illustrating an operation of the level converter when transition from a normal display region to a non-display region occurs in partial display mode.

Next, the operation will be described with reference to the timing chart in FIG. 6 when a transition from the normal display region to the non-display region occurs in partial mode. As is shown in FIG. 6, the control signal CNT and the enable signal ENB are synchronized.

During displaying in partial mode, when the control signal CNT goes to the "L" level at time t11 (the transition from the display region to the non-display region), the B control signal selection circuit 34 selects the control signal YB, that is, the "H" level selector pulse XSEL-G (the inversion of the selector pulse SEL-G) that is fed to the CK input of the level shifter 31. Providing the "H" level signal to the CK input activates the level shifter 31 that level shifts the selector pulse sel-B, which has the voltage swing corresponding to the external-circuit power supply, to the selector pulse SEL-B, which has the voltage swing corresponding to the internal-circuit power supply.

When the selector pulse SEL-B is level shifted, the output signal from the AND gate 40, that is, the control signal YG goes to the "H" level at time t12 at the positive edge of the selector pulse SEL-B. The G control signal selection circuit 35 selects the "H" level control signal YG that is fed to the CK input of the level shifter 32. Providing the "H" level input to the CK input activates the level shifter 32 that level shifts the selector pulse sel-G, which has the voltage swing corresponding to the external-circuit power supply, to the selector pulse SEL-G, which has the voltage swing corresponding to the internal-circuit power supply.

When the selector pulse SEL-G is level shifted, the inverted selector pulse XSEL-G goes to the "L" level. The "L" level inverted selector pulse XSEL-G is fed via the B control signal selection circuit 34 to the CK input of the level shifter 31. Providing the "L" level signal to the CK input deactivates the level shifter 31 that produces a pulse having the latched polarity regardless of the polarity of the input selector pulse sel-B. The selector pulse SEL-B is therefore maintained at the "H" level.

At the same time, the output signal from the AND gate 41 goes to the "H" level at time t13 at the positive edge of the selector pulse SEL-G. The "H" level output signal from the AND gate 41 is fed to the set input of the RS flip-flop 43 that enters the set state. Setting the RS flip-flop 43 produces the "H" level "Q" output. The R control signal selection circuit 36 selects the "H" level "Q" output that is fed to the CK input of the level shifter 33. Providing the "H" level signal to the CK input activates the level shifter 33 that level shifts the selector pulse sel-R, which has the voltage swing corresponding to the external-circuit power supply, to the selector pulse SEL-R, which has the voltage swing corresponding to the internal-circuit power supply.

When the selector pulse SEL-R is level shifted, the output signal from the AND gate 40 goes to the "L" level at time t14 at the positive edge of the selector pulse SEL-R (or the negative edge of the selector pulse XSEL-R), the "L" level YG signal is fed via the G control signal selection circuit 35 to the CK input of the level shifter 32.

Providing the "L" level signal to the CK input deactivates the level shifter 32 that produces the pulse having the latched polarity regardless of the polarity of the input selector pulse sel-G. The selector pulse SEL-G is therefore maintained at the "H" level.

When the enable signal ENB indicating the end of writing in one horizontal period goes to the "L" level, the output signal from the inverter 42 goes to the "H" level at time t15. The "H" level output from the inverter 42 resets the RS flip-flop 43, causing the "Q" output of the RS flip-flop 43 to be at the "L" level. The R control signal selection circuit 36 selects the "L" level YR control signal, which is output to the CK input of the level shifter 33. Providing the "L" level signal to the CK input deactivates the level shifter 33 that produces a pulse having the latched polarity regardless of the polarity of the input selector pulse sel-R. The selector pulse SEL-R is therefore maintained at the "H" level.

The above operation causes writing each pixel of the first line to be completed in the non-display region in partial mode. Thereafter, the selector pulses SEL-B, G, and R continue to be output from the polarity ("H" level) latched in the level shifters 31, 32 and 33, respectively, during single gradation displaying, that is, white display in normally white mode or black display in normally black mode. This allows the selector switches SWb, SWg, and SWr to be maintained in the ON state, thus sequentially writing the display signal of the single gradation to the non-display region in groups of lines.

When partial mode for displaying only part of the display screen is requested, the level shifters 31, 32, and 33 of the level converter 14 are controlled based on the control signal CNT and the enable signal ENB fed from the timing generator disposed outside or inside the liquid crystal panel 15 to activate/deactivate the level shifters 31, 32, and 33 while the pixels of the first line of the non-display region are written. Thereafter, the level shifters 31, 32, and 33 maintain deactivated until displaying in the non-display region is completed.

Therefore, the display signal of a single gradation corresponding to the non-display region in partial mode can be written in the non-display region except its first line without the operations of the level shifters 31, 32, and 33. Since no direct current power consumption by the level shifters 31, 32, and 33 occurs in the non-display region except its first line, the power consumption in the level converter 14 and, ultimately, in the entire device.

In the above embodiment is described the example in which the present invention is applied to the liquid crystal display using the liquid crystal cell as the display element of the pixel. However, the present invention is not limited to the liquid crystal display and may be applied to selector-addressing method type display devices having the partial display function, such as an EL display device using an electroluminescent cell as the display element of the pixel.

Figure 7:
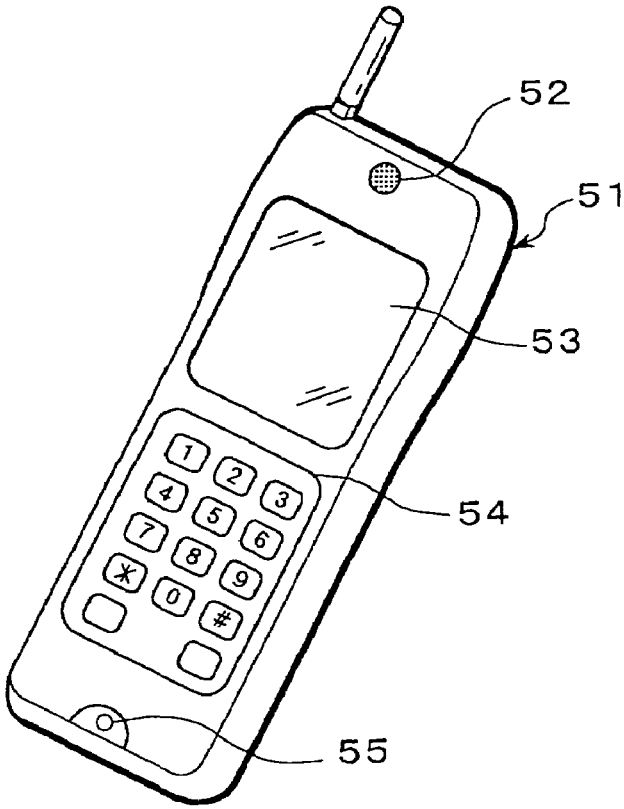
FIG. 7 is an outline view showing a construction of a portable phone according to the present invention.

FIG. 7 is an outline view showing the construction of a portable terminal apparatus, such as a portable phone, according to the present invention.

The portable phone includes a loudspeaker 52, an output display unit 53, an operation unit 54, and a microphone 55 on the front surface of a casing 51. The output display unit 53 uses, for example, the above-described liquid crystal display device.

Figure 8:
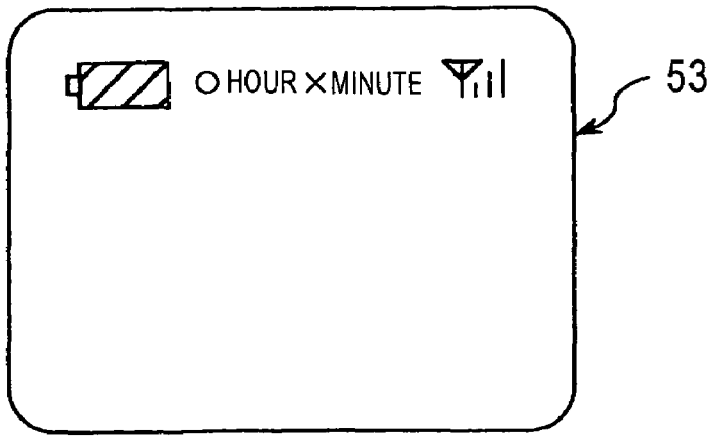
FIG. 8 is a diagram showing an example display of an output display unit.

This type of the portable phones has partial mode in which displaying is performed in a partial region of the output display unit 53 in the horizontal direction during standby mode. For example, as shown in FIG. 8, information regarding the battery residual, the receiver sensitivity, and time is constantly displayed. In the rest of the non-display region, white display is performed in a normally white-type liquid crystal display device or black display is performed in a normally black-type liquid crystal display device.

In the portable telephone provided with the output display unit 53 having, for example, the partial display mode, the output display unit 53 uses the above-described liquid crystal display device. When one of the selectors is not selected and the respective level converter (level shifter) is deactivated, the direct current consumption is reduced, enabling low-power consumption output display 53 to be realized. In particular, direct current consumption can be greatly reduced in partial display mode by deactivating the level converter in the non-display region except its first line. Since further low consumption of the output display unit 53 can be realized, the operating time of the apparatus per one battery charge can be prolonged.

Although the example applied to the portable phone is described, the present invention can be applied to any type of portable terminal apparatus, such as a subunit of an extension phone system and a PDA.

What is claimed is:

1. A display device comprising:

a pixel unit having an array of pixel elements;

a plurality of digital signal level converter elements each being associated with different regions of the pixel unit, wherein the digital signal level converter elements each receives an input digital signal at a first potential level and outputs a corresponding digital signal at a second potential different from the first; and wherein each of the plurality of digital signal level converter elements is deactivated when the region associated with the corresponding level converter element is not actively displaying information, such that, when deactivated, a change in value of the input digital signal does not result in a corresponding change in the output digital signal.

2. The display device according to claim 1, wherein said input digital signals are pixel data signals.

3. The display device according to claim 1, wherein said digital signal level converter latches the signal output value upon deactivation such that the signal output just prior to deactivation continues to be output after deactivation.

4. The display device according to claim 1, wherein the display device also receives a control signal and an enable signal, both of which at least partially determine whether each of the digital signal level converters is in a state of deactivation or activation.

5. A method of driving a display device comprising:

providing a pixel unit having an array of pixel elements;

providing a plurality of digital signal level converter elements each being associated with different regions of the pixel unit, wherein the digital signal level converter elements receives an input digital signal at a first potential level and outputs a corresponding digital signal at a second potential different from the first; and deactivating each of the digital signal level converter elements when the region associated with the corresponding level converter element is not actively displaying information, such that, when deactivated, a change in value of the input digital signal does not result in a corresponding change in the output digital signal.

6. The method of driving a display device according to claim 5, wherein said input digital signals are pixel data signals.

7. The method of driving a display device according to claim 5, wherein said digital signal level converter latches the signal output value upon deactivation such that the signal output just prior to deactivation continues to be output after deactivation.

8. The method of driving a display device according to claim 5, wherein the display device also receives a control signal and an enable signal, both of which at least partially determine whether each of the digital signal level converters is in a state of deactivation or activation.

9. A display device comprising:

a pixel unit having an array of pixel elements;

a plurality of signal level converter elements each being associated with different regions of the pixel unit, wherein the signal level converter elements each receives an input signal at a first potential level and outputs a corresponding signal at a second potential different from the first; and wherein each of the plurality of signal level converter elements is deactivated when the region associated with the corresponding level converter element is not actively displaying information, such that, when deactivated, a change in value of the input signal does not result in a corresponding change in the output signal.

10. The display device according to claim 9, wherein said input signals are pixel data signals.

11. The display device according to claim 9, wherein said digital signal level converter latches the signal output value upon deactivation such that the signal output just prior to deactivation continues to be output after deactivation.

12. The display device according to claim 9, wherein the display device also receives a control signal and an enable signal, both of which at least partially determine whether each of the digital signal level converters is in a state of deactivation or activation.

* * * * *